United States Patent [19]

Norden

[11] 4,350,965

[45] Sep. 21, 1982

[54] MULTI-POLE CIRCUIT BREAKERS

[75] Inventor: Alexander R. Norden, New York, N.Y.

[73] Assignee: Federal Pacific Electric Company, Newark, N.J.

[21] Appl. No.: 255,154

[22] Filed: Apr. 17, 1981

[51] Int. Cl.[3] ..... H01H 75/00; H01H 77/00; H01H 83/00

[52] U.S. Cl. ..... 337/47; 335/8; 335/189

[58] Field of Search ..... 337/47-50; 335/8-10, 191, 180, 189

[56] References Cited

U.S. PATENT DOCUMENTS

| | | | |
|---|---|---|---|
| 2,923,788 | 2/1960 | Norden | 200/74 |
| 2,923,795 | 2/1960 | Martin | 200/116 |
| 4,146,855 | 3/1979 | Schultz et al. | 335/8 |

*Primary Examiner*—Harold Broome

*Attorney, Agent, or Firm*—Ronald R. Stanley; Roy F. Hollander

[57] ABSTRACT

A circuit breaker for interrupting current through plural electrical circuits has a separate current responsive circuit path for each electrical circuit. Each path includes a manually operable latching mechanism capable of engaging and disengaging a pair of electrical contacts on demand and further includes a circuit responsive releaseable latch mechanism for automatically disengaging the pair of contacts. A common manually activated handle is connected to each of the latching mechanisms to enable manual and automatic operation of the breaker for simultaneous engagement or disengagement of the paired electrical contacts. The connection of the common handle to the several latching mechanisms encompasses a trip bar arranged for both pivotal movement about an axis parallel to the axis of the handle and sliding movement relative to guides within a common insulating case of the circuit breaker. The disclosed breaker assures tripping of all latching mechanisms, instantly, upon release by any one or more of the circuit responsive mechanisms. The pivotal and sliding movement of the trip bar eliminates high frictional forces between the linkage portions and permits the use of a minimal overcenter angle to latch the breaker.

13 Claims, 9 Drawing Figures

MULTI-POLE CIRCUIT BREAKERS

BACKGROUND OF THE INVENTION

The present invention relates to automatic circuit interrupters and, more particularly, to circuit interrupters or circuit breakers including individual current paths for more than one pole or circuit which are manually resettable and automatically releaseable, simultaneously.

Circuit breakers commonly include a fixed electrical contact and a moveable electrical contact, to which line and load conductors are connected. The moveable contact is connected through a toggle arrangement, such as an overcenter linkage, to a manually operable handle to engage or disengage the moveable contact and the stationary contact, corresponding to closing and opening the circuit breaker, respectively. A particular circuit breaker generally includes one or more circuit responsive releaseable latch mechanisms which automatically cause the stationary and moveable contacts to disengage. These releaseable latch mechanisms may take the form of, for example, bimetallic or other thermal releasing mechanisms, magnetic releases, or solenoid operated releases. When the circuit breaker is to disengage the moveable and the stationary contacts as a result of one or more of the releaseable latching mechanisms functioning, it is desirable that the physical opening of the contacts occur at as rapid a rate as possible. In this regard, the life of the breaker is directly related to the amount of arcing occurring between the contacts as the contacts open, which in turn is related to the amount of time required to separate the contacts.

Often, two or more breaker mechanisms are arranged to be immediately adjacent within a common breaker enclosure for the purpose of protecting electrical circuits having more than one pole or branch. A requirement of such multi-pole circuit breakers is that all poles break the circuit if any one pole is activated by an automatic release mechanism. Simultaneous opening of all poles of a breaker is commonly accomplished by providing a mechanical member between the latching mechanisms of all poles of the breaker, resulting in automatic opening action of any one pole disengaging or unlatching all other poles. When the circuit responsive releaseable latch is present in the circuit breaker as part of the moveable portion of the breaker, connecting adjacent poles for simultaneous tripping is subject to difficulties.

One approach to the coupling of individually moveable latching linkage breakers to provide multi-pole protection involves the use of a common trip bar within an overcenter linkage of the multiple breaker units. The trip bar is connected to a common actuating handle and to each moveable latching linkage through individual pivoted links, one for each pole. A closing force exerted upon the common handle is transmitted to each moving contact assembly through an overcenter toggle linkage assembly including the common trip bar. A device such as discussed immediately above is shown in U.S. Pat. No. 2,923,795 assigned to the same assignee as the present invention. When any one circuit responsive releaseable latch is actuated, that particular pole rotates counterclockwise, in turn applying a counterclockwise force to the common trip bar. Rotation of the trip bar causes movement of pivots of the other overcenter toggle linkages of the remaining poles and results in collapse of the toggle mechanisms. All linkages rotate counterclockwise thus opening current paths substantially simultaneously for all poles.

As the frictional forces between the common trip bar and the handle increase, movement of the handle which is being rotated counterclockwise when closing the breaker, may cause the common trip bar to likewise rotate counterclockwise tending to collapse the overcenter toggle linkages. To overcome this problem, the angle at which the overcenter toggles latch may be increased. The increase, however, may cause the force produced by unlatching one pole to be insufficient at times to collapse the increased overcenter toggle forces of the other poles.

Operation of a circuit breaker in accordance with the above cited patent may be improved by replacing the frictional bearing relationship between the handle and the common trip bar with pivot pins and slots. These pivot pins allow rolling of the common trip bar relative to the handle rather than frictional rubbing. Since the pins and slots define the path through which the common trip bar moves, the initial and final points of this path may be predetermined so as to provide a high overcenter toggle angle at the beginning of movement, with a small angle near the end. Such a device is shown in U.S. Pat. No. 2,923,788 and is assigned to the same assignee as the present invention.

The arrangement of the last mentioned patent provides proper seating of the overcenter links while eliminating the possibility of collapse of the links in fast closing circuit breakers. In slow closing circuit breakers, contact closure occurs very near the midpoint of handle movement where the device of the mentioned patent is still in its high initial overcenter toggle state. If contacts of one pole touch at a point in the closing stroke before the minimal toggle angle has been reached, the tripping force of that one pole may be insufficient to cause collapse of the linkage and simultaneous opening of the other poles.

SUMMARY OF THE INVENTION

In accordance with the present invention, a multi-pole circuit breaker is provided which assures positive latching of the breaker in a contact closed condition while enabling the circuit responsive release of any one of the poles to positively unlatch and thus open all of the poles of the breaker.

While the invention is illustrated and described in the attached specification and drawings and certain of its aspects as applied to a three pole breaker, the invention is equally applicable to other circuit breakers having more than one pole.

A primary object of the present invention is a circuit breaker having multiple circuit protective devices arranged to provide simultaneous, automatic opening of all of the individual circuit protective devices upon tripping of any one of the circuit protective devices.

A further object of the present invention is a circuit breaker which provides multi-pole protection for an electrical circuit and assures reliable simultaneous tripping of all poles of the breaker upon automatic release of a latch of any one pole, by virtue of the elimination of frictional forces between adjacent portions of the circuit breaker latching mechanisms.

In a multi-pole circuit breaker using moving contact latching mechanisms, an overcenter toggle mechanism used for latching each contact mechanism preferably latches at a minimum angle in order to expedite automatic opening of the breaker. A common trip bar is used to connect all of the poles in the circuit breaker for simultaneous opening of all poles by any one automatic release. An overcenter toggle angle is reduced to a minimal value to assist in tripping of the breaker by eliminating or reducing frictional forces encountered by the breaker as a result of the trip bar being a part of the linkage of the overcenter toggling mechanism. One edge of the common trip bar is rotatably mounted along an axis parallel to an axis of the operating handle of the circuit breaker. An exacting relationship is provided between the movement of the other edge of the common trip bar and the circuit breaker enclosure. As a result of the precise positioning of both edges of the trip bar, torques which would be created by friction between the common trip bar and the pivots which define its axis of rotation are effectively eliminated.

A further object of the present invention is therefore a multi-pole circuit breaker which allows a plurality of moveable contact overcenter toggle linkage mechanism to be latched with a minimum overcenter angle.

The foregoing and other novel features, objects and advantages are better appreciated from the following detailed description of the illustrated embodiment shown in the accompanying drawings.

DETAILED DESCRIPTION OF THE PREFERRED EMBODIMENT

Figure 1:
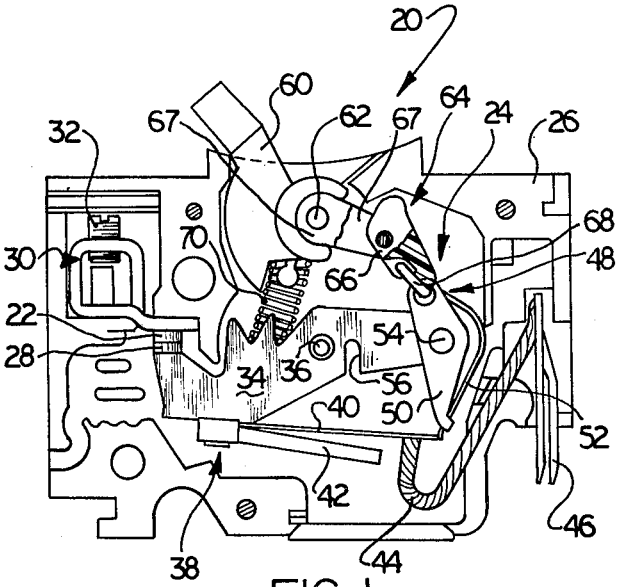
FIG. 1 is a side view of a circuit breaker with a portion of a case structure removed, illustrating one set of paired contacts in a closed condition in accordance with the preferred embodiment of the present invention.
Figure 6:
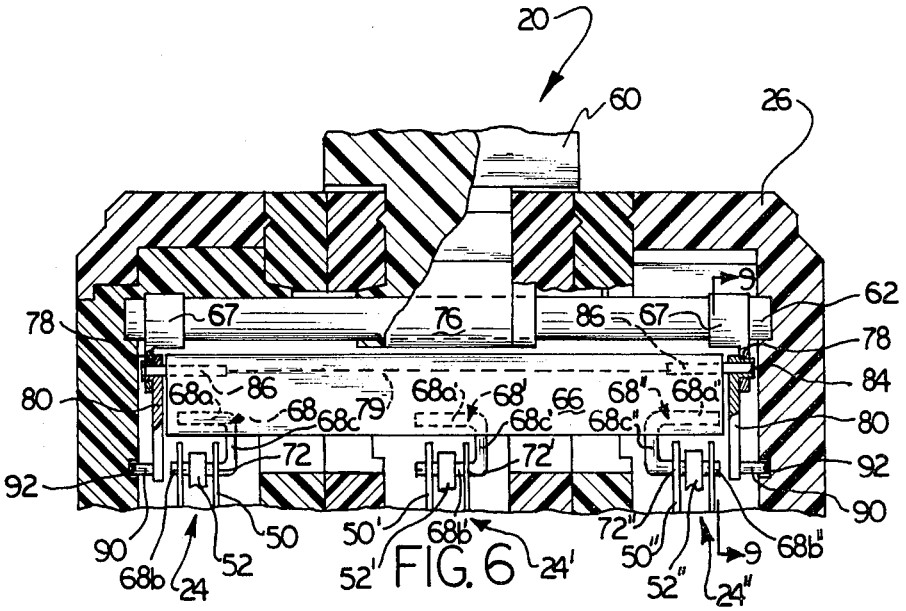
FIG. 6 is a fragmentary transverse section of the circuit breaker shown in FIGS. 1 through 5, illustrating the interconnection of a common trip bar and several overcenter latching mechanisms of the present invention.

Referring to FIG. 1, a circuit breaker 20 includes a stationary contact 22 and a moveable contact mechanism 24 mounted within an enclosure 26. Engagement and disengagement of the stationary contact by a moveable contact 28 supported by the moveable contact mechanism is manually attainable. Enclosure 26 is constructed of an insulating material such as, for example, urea. The enclosure completely surrounds moveable contact mechanism 24 thus insulating the same from exterior intervention and immediately adjacent moveable contact assemblies 24' and 24" as illustrated in FIG. 6. A portion of enclosure 26 has been removed from each of the circuit breakers shown in FIGS. 1 through 6. The exterior dimensions and shape of circuit breaker 20 conform to the particular enclosure in which the circuit breaker is intended to be used.

In FIG. 1, stationary contact 22 is shown permanently affixed to a contact assembly 30 which includes a screw 32 threaded therethrough for binding a wire (not shown) to a portion of the circuit. Moveable contact mechanism 24 includes a body portion 34 which has the moveable contact permanently affixed thereto at one extreme end. Body portion 34 is mounted for rotational movement relative to enclosure 26, and thus stationary contact 22, as a result of a pin or spring 36 extending through the body portion and mounted within appropriately formed recesses in the enclosure.

A current responsive releaseable latch mechanism 38 is secured to body portion 34 near the moveable contact. Current responsive latch 38, including a current responsive bimetal 40 and a soft iron core 42 are jointly securely attached at the lower left edge of body 34 (as shown in FIG. 1) by staking or any other means of permanently fastening the latch to the body. One end of a flexible metal braid 44 is permanently secured to the free end of current responsive bimetal 40 as by welding, while the remaining end of the metal braid is secured to a terminal 46 which extends from enclosure 26 for connection to the other side of the circuit. While the terminal used for connecting the circuit breaker to the supply is shown as a plug-in type terminal, any form of electrical termination may be used to provide adequate connection of the circuit breaker to the circuit. When the moveable contact assembly is pivoted clockwise about pivot 36 to provide engagement of stationary contact 22 and moveable contact 28, a complete current path is provided through terminal 46, metal braid 44, bimetal 40, body portion 34, moveable contact 28 and stationary contact 22.

At the end of body portion 34 most extreme from moveable contact 28, a bell crank or toggle 48 is pivotally mounted to the body portion. Toggle 48 includes a body 50 and a latching member 52 and is connected to body portion 34 at pivot 54 which is arranged to be an insulating pivot for reasons further explained hereinbelow. As illustrated in FIG. 1, when the toggle is rotated clockwise about pivot 54, the extreme lower edge of latching member 52 engages the free edge of temperature responsive bimetal 40 to form a portion of a closed mechanical link. This closed link is required to latch the breaker with contacts 22 and 28 engaged. Calibration of the circuit breaker is possible by increasing or decreasing gap 56 within body portion 34 to provide a predetermined overlap of latching member 52 and bimetal 40. As noted above, the current path from terminal 46 to contact assembly 30 requires that the electrical current be conducted through wire braid 44 and bimetal 40 to the body portion and through contacts 28 and 22 when these contacts are engaged. The insulating pivot of toggle 48 prevents current from bypassing the temperature sensitive bimetal 40 by conduction through latching member 52 and body 50 of the toggle.

Circuit breaker 20 is manually operable to engage and disengage contacts 22 and 28, corresponding to closing and opening the circuit breaker, respectively. A handle 60, providing the means of manual operation of the breaker, is pivotally mounted on a pivot bar 62 and extends through an opening in the upper surface of enclosure 26. Handle 60 is connected to toggle 48 through an overcenter linkage arrangement 64 enabling the breaker to be locked in the engaged position when the handle is moved to the left as viewed in FIG. 1. The overcenter linkage arrangement includes a common trip bar 66 which is pivotally connected to handle 60 by arms 67 fixedly secured to pivot bar 62 and individually connected to toggle 48 of each pole of circuit breaker 20 by a link 68. The handle, shown in a closed position in FIG. 1 corresponding to contacts 22 and 28 being engaged, is spring biased by a spring 70 toward the open position. The latching of circuit breaker 20 in a closed condition, and the consequential overcenter latching of linkage 64 may be further understood with the aid of U.S. Pat. Nos. 2,923,788 and 2,923,795 mentioned hereinabove.

Operation of circuit breaker 20, and the functioning of overcenter linkage 64 in latching the circuit breaker, is better understood with the aid of FIGS. 1 through 5. FIGS. 1, 2, 3 and 5 represent the same pole of a three pole circuit breaker, as for example the left-most pole in FIG. 6. In FIG. 1, the circuit breaker has been manually closed by moving handle 60 from the right to the left, as viewed in the figure, causing body portion 34 to rotate clockwise about pivot 36 thus engaging contacts 22 and 28. When the breaker is closed, latching member 52 of toggle 48 engages the free edge of temperature responsive bimetal 40. Trip bar 66 together with link 68, arm 67 and toggle 48 are all in an overcenter position thus latching moveable contact mechanism 24 and handle 60 in a closed position against the pressure of spring 70.

Figure 2:
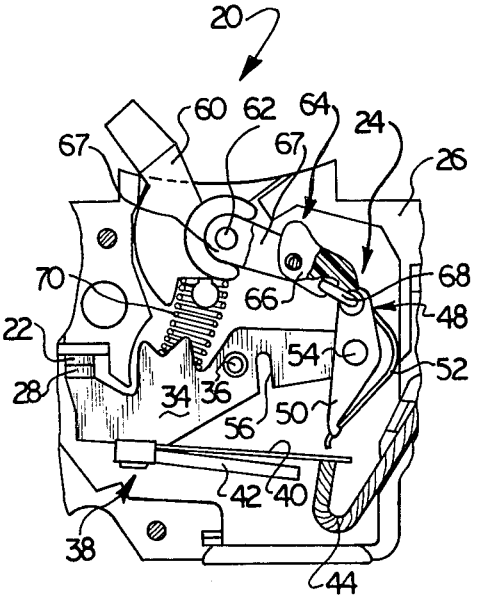
FIG. 2 is a fragmentary side view of the circuit breaker shown in FIG. 1, with a portion of the case structure removed, illustrating the set of paired contacts in a closed condition with an overcenter toggle linkage shown in a state corresponding to conditions immediately after release by a circuit responsive release mechanism.
Figure 3:
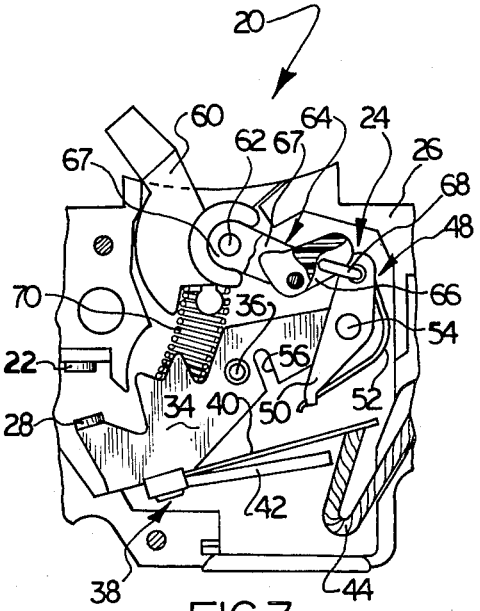
FIG. 3 is a fragmentary side view of the circuit breaker shown in FIG. 1, with the paired contacts in a tripped and opened condition and the overcenter toggle linkage in a completely unlatched position, while a handle is held in the "ON" position.
Figure 4:
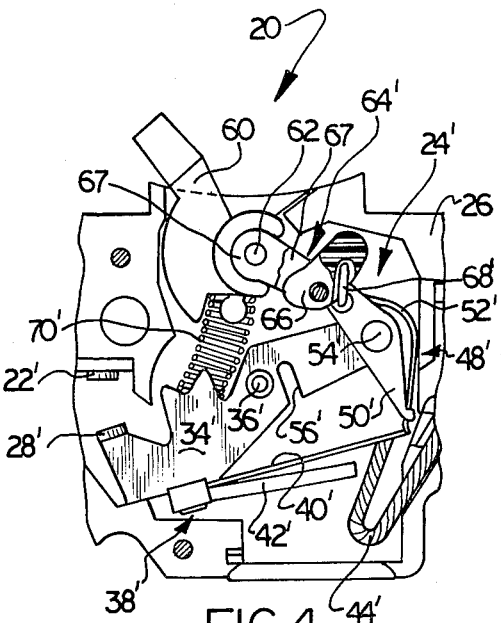
FIG. 4 is a fragmentary side view of the circuit breaker shown in FIG. 3, illustrating an untripped pole which has opened as a result of the tripping of an adjacent pole.

As the level of current carried by circuit breaker 20 approaches the threshold level of temperature responsive bimetal 40, downward movement of the bimetal causes the extreme edge of latching member 52 to be released by the bimetal (FIG. 2). With latching member 52 and bimetal 40 disengaged, toggle 48 rotates clockwise about pivot 54 which releases overcenter linkage 64 from its locked overcenter position. Continual clockwise rotation of toggle 48 about the pivot, results in moveable contact mechanism 24 rotating counterclockwise about pivot 36 and disengaging contacts 22 and 28 (FIG. 3). It should be noted at this point that handle 60 in FIGS. 3 and 4 is restrained in the contact closed position in order to better provide an understanding of the operation of toggle 48 and overcenter linkage 64. In fact, except when handle 60 is prevented from rotating by human hand or external locking means, once the overcenter toggle collapses, spring 70 forces handle 60 to return to the contact open or right hand position as viewed in FIG. 5.

FIG. 4 represents a pole of circuit breaker 20, as for example moveable contact mechanism 24' corresponding to the center pole in FIG. 6, which has not been tripped as a result of activation of its own current responsive bimetal 40, but is in "contacts open" position as a result of tripping of another pole of circuit breaker 20. FIG. 4 implies that left-most moveable contact mechanism 24, or right-most mechanism 24'' (FIG. 6) has tripped and handle 60 is being held in the contact closed position. Body portion 34' as shown in FIG. 4 has rotated fully counterclockwise about pivot 36' resulting in the disengagement of contacts 22' and 28'. Although toggle 48' still has latching member 52' engaging bimetal 40', overcenter linkage 64' has collapsed due to the rotation of trip bar 66 caused by the release of toggle 48. The operation of common trip bar 66 in forcing all poles of breaker 20 to trip when any one of the current responsive bimetals triggers may be understood with the aid of FIGS. 6 through 9.

Figure 8:
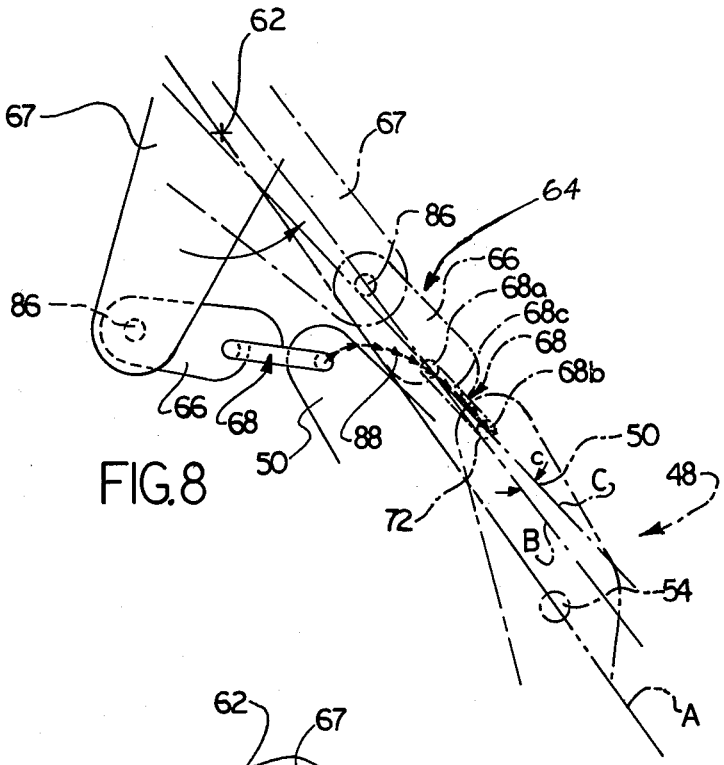
FIG. 8 is a schematic diagram of the relative positions of one overcenter toggle mechanism, the trip bar and one pivot link in accordance with the present invention illustrating the contact opened and closed conditions; and, FIG. 9 is a cross sectional view of the circuit breaker of the present invention taken along line 9—9 of FIG. 6.
Figure 9:
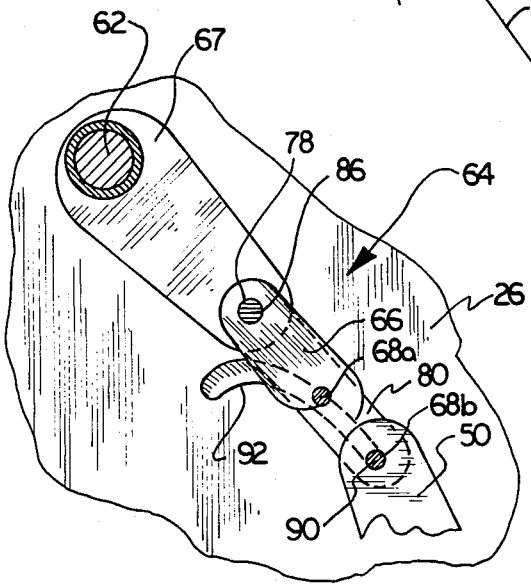

FIG. 8 schematically describes the preferred operation of overcenter linkage 64 in moving from the open condition (shown in solid lines) to the closed condition (shown in phantom lines). Body 50 of toggle 48 is connected to common trip bar 66 by link 68 at a pivot point 72 as noted above. Sufficient clearance is provided between link 68 and common trip bar 66 to allow free pivotal motion of the toggle relative to the link. Likewise, the relationship between common trip bar 66 and the link is sufficient to allow pivotal motion of the trip bar.

As seen in FIG. 6, pivot bar 62, on which handle 60 is rotatably mounted, is restrained by opposite sides of enclosure 26 and rotates relative to the enclosure when the handle is operated manually. In order to maintain a constant relationship between handle 60 and pivot bar 62, the handle includes an interior extension 76 which is securely affixed to the pivot bar requiring handle 60 and pivot bar 62 to move in unison. At each end of pivot bar 62, and immediately adjacent to each outermost wall of the enclosure, arms 67 extend radially outward from the pivot bar. The arms are affixed to pivot bar 62 and therefore move in identical arcs as the pivot bar is turned.

Near the free end of each arm 67 is an aperture 78. The apertures of both arms 67 jointly define an axis 79 (FIG. 6) parallel to pivot bar 62. A pivot link 80 is pivoted in each of the arms by an integral tubular member 82 (FIG. 7) extending into aperture 78 of the arm. Opening 84 through tubular member 82 acts as bearing surface for pin 86 extending from each edge of common trip bar 66 along axis 79. Trip bar 66 and pivot links 80 are therefore coaxially, pivotally mounted within aperture 78 of the arms. It may be easily understood that while axis 79 is capable of movement in an arc about pivot bar 62, axis 79 always remains parallel to pivot bar 62.

Arm 67 is driven about its center, pivot bar 62, in a counterclockwise direction as the handle is moved to the left. A line "A" extending from the center of arm 67 through pivot 54 of toggle 48 indicates the center line of overcenter linkage 64, in FIG. 8. A line "B" extends through the centers of pivot 86 and an upper arm 68*a* of the link 68. Upper arm 68*a* is parallel to a lower arm 68*b* of the link and are thus both parallel to pin 86 and the pivot bar. The upper and lower arms of link 68 are connected by a vertical portion 68*c* of the link to pivotally connect trip bar 66 and body 50 of the toggle. A line "C" extends axially along the center of vertical portion 68*c* of the link. The degree of overcenter travel of linkage 64 is measured by an angle "c" between line "B" and line "C". This degree of overcenter travel is approximately proportional to the magnitude of angle "c".

Figure 7:
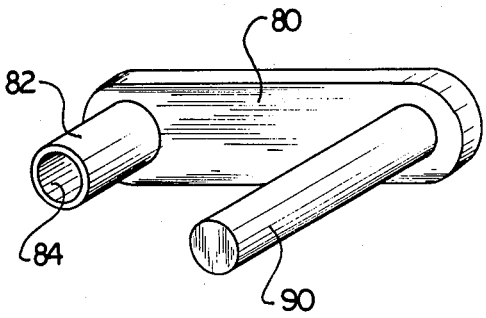
FIG. 7 is a perspective view of a pivot link used in rotatably connecting the common trip bar to a handle mechanism.
Figure 5:
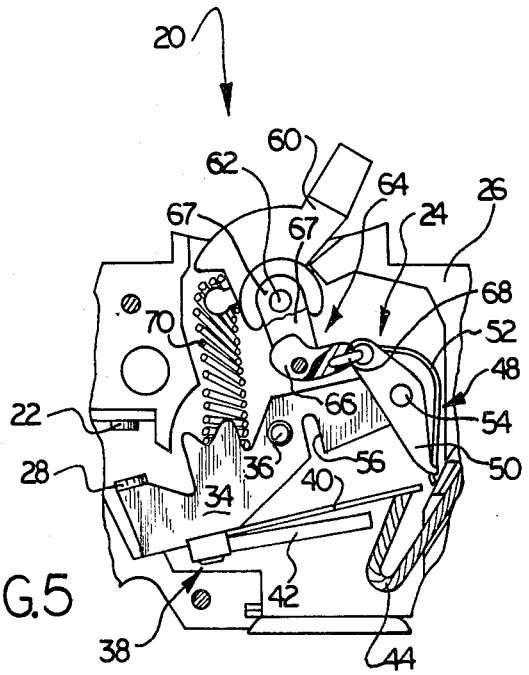
FIG. 5 if a fragmentary side view of the circuit breaker shown in FIG. 1, illustrating the contact pair in an open condition with the handle in an open or "OFF" state.

As viewed in FIG. 8, when the overcenter linkage moves from an "OFF" position to an overcenter latched position, lower arm 68*b* of link 68, and thus pivot point 72, move through a given locus 88, indicated by the arrows. Each of pivot links 80 is provided with a pin 90 extending from the lower edge of the pivot link in a common direction with tubular member 82 (FIG. 7). Pin 90 is spaced from tubular member 82 a distance equal to that between pin 86 and lower arm 68*b* of the link, when trip bar 66 and link 68 are in a latched overtoggle condition. When the circuit breaker is assembled, pins 90 extend outwardly toward the most extreme walls of enclosure 26. A groove 92 of the same shape as locus 88 is provided in the inner surface of each extreme wall of enclosure 26 to guide pins 90 during movement of the overcenter toggle linkage. Since tubular member 82 of the link is coaxial with pin 86, and further pin 90 of the link follows locus 88 of the movement of lower arm 68*b*, clearly with the aid of FIG. 9, projections 82 and 90 of link 80 move through precisely the same path as pivot points 86 and 72, respectively, of trip linkage 64.

Counterclockwise rotation of arm 67, as viewed in FIG. 8, toward overcenter line "A" results in rotational motion between arm 67 and link 80, but, as a result of moving in a common path, no rotational motion between opening 84 of the link and pin 86 of the trip bar. Trip bar 66, therefore, moves downward and to the right into the overcenter position. If link 80 were eliminated, the frictional forces between pin 86 and aperture 78 of arm 67 would tend to rotate trip bar 66 counterclockwise together with arm 67, causing collapse of the toggle linkage.

There is no relative movement between link 80 and trip bar 66 during closing of the toggle, including no relative rotational motion. This lack of motion results in no frictional drag to cause collapse of the toggle. Link 68 and trip bar 66 can therefore be virtually in a straight line, thus minimizing the force needed to collapse the toggle as a result of tripping of any one pole. Angle "c" is a critical angle for latching the toggle mechanism. Introduction of link 80 into the mechanism enables angle "c" to be minimized (approaching zero), decreasing the effort necessary to intentionally collapse the toggle, while maintaining effectiveness of the overcenter toggle linkage to avoid unintentional collapse.

Modifications, changes and improvements to the preferred forms of the invention herein disclosed, described and illustrated may occur to those skilled in the art who come to understand the principles and precepts thereof. Accordingly, the scope of the invention should not be limited to the particular embodiments set forth herein, but rather should be limited only by the advance by which the invention has promoted the art.

What is claimed is:

1. A multi-pole circuit breaker including in combination a pair of separable contacts in each of a plurality of adjacent poles, a common manually operable handle for all said poles, each said pair of contacts having a latching contact linkage connected to said common operable handle to engage and disengage each said pair of contacts manually, each said latching linkage including a current-responsive release means for releasing the said latching linkage upon occurrence of a predetermined current level therethrough, said latching linkage including additional release means for releasing each said pair of contacts when any one of said current-responsive release means detects the predetermined current level, each said latching linkage providing latching of said pair of contacts in engagement when said linkage is moved overcenter, and a rotatable shaft spaced from said latching linkages, said manually operable handle fixedly secured to said shaft for rotating said shaft, a pair of oppositely disposed depending arms fixedly secured to said shaft, link means journalled within aligned apertures in said pair of arms, and bar means for interconnecting the latching linkages, said bar means supported by said link means, whereby rotational motion of said bar means relative to said link means is prevented and overcenter movement of said linkage is minimized.

2. The circuit breaker according to claim 1 wherein said common operator further includes guide means for limiting movement of said link means as said handle is operated to engage and disengage said plurality of poles.

3. The circuit breaker according to claim 1 wherein said bar means has a central axis which is generally parallel to said shaft and coaxial with the apertures in said arms.

4. The circuit breaker according to claim 1 including a common insulating enclosure, said common manually operable handle positioning said pairs of contacts in opened and closed positions, said rotatable shaft mounted within said enclosure.

5. The circuit breaker according to claim 4 wherein said pair of arms extend radially away from said shaft, said arms located near opposite ends of said shaft and adjacent to opposite sides of said enclosure, said arms being rigidly secured to said shaft.

6. The circuit breaker according to claim 5 wherein said trip bar means further includes a pair of pivot links mounted for rotation about the same axis as said bar.

7. The circuit breaker according to claim 6 wherein said bar and said pair of pivot links are coaxially mounted within respective apertures in said pair of arms.

8. The circuit breaker according to claim 7 wherein each of said pivot links is adjacent to one of said opposite sides of the enclosure, each said side having a contoured groove therein of a predetermined shape, each of said pivot links having an outwardly extending pin which is arranged to be constrained within a corresponding one of said grooves.

9. The improvement according to claim 7 wherein said additional release means includes means connecting each latching linkage of the circuit breaker to said bar.

10. In a circuit interrupter for protecting a plurality of electrical circuits, each said circuit having a corresponding stationary contact, a movable contact and a linkage arrangement supporting said movable contact for engagement with and disengagement from said stationary contact, each said linkage arrangement including a latching toggle and at least one current responsive releasable latch, the circuit interrupter having a common insulating enclosure and a common linkage activitating handle exterior to said enclosure for the plurality of circuits, said common handle secured to a shaft rotatably mounted between opposite side walls of said enclosure, the improvement comprising: trip bar means for interconnecting the linkage arrangements of said circuits, said shaft having oppositely disposed depending arms with aligned apertures, said trip bar means including link means journalled within the apertures of said arms and an elongated bar supported by said link means in axial alignment with said apertures, whereby said trip bar means forces said plurality of linkage arrangements to engage said stationary and movable contacts and latch said toggles when said common handle is operated in a first direction, and said trip bar means forces said common handle in a second direction to cause said plurality of linkage arrangements to disengage said stationary and movable contacts when any one of said current responsive releasable latches unlatch one of said latching toggles.

11. The improvement according to claim 6 wherein said trip bar means includes guide means for directing the movement of said elongated bar when said shaft is rotated to assure no rotation occurs between said bar and said links.

12. The improvement according to claim 7 wherein said guide means includes at least one pin and at least one contoured guideway correspondingly engaged between said trip bar means and said enclosure.

13. The improvement according to claim 8 wherein said pin extends from said link in the direction of said enclosure and said guideway is a groove in an inner surface of said enclosure having a predetermined contour.

* * * * *